United States Patent [19]

Asmussen et al.

[11] Patent Number: 4,870,265

[45] Date of Patent: Sep. 26, 1989

[54] POSITION-SENSITIVE RADIATION DETECTOR

[75] Inventors: Frithjof Asmussen; Thomas Schiller; Uwe Weigmann, all of Berlin, Fed. Rep. of Germany

[73] Assignee: Max-Planck Gesellschaft zur Foerderung der Wissenschaften eV, Göttingen, Fed. Rep. of Germany

[21] Appl. No.: 120,116

[22] Filed: Nov. 13, 1987

[30] Foreign Application Priority Data

Nov. 14, 1986 [DE] Fed. Rep. of Germany ..... 3638893

[51] Int. Cl.[4] ..... H01J 40/14

[52] U.S. Cl. ..... 250/211 R; 250/213 R

[58] Field of Search ..... 250/213 R, 213 VT, 211 R; 313/524, 527, 528, 540

[56] References Cited

U.S. PATENT DOCUMENTS

| | | | |
|---|---|---|---|
| 2,698,915 | 1/1955 | Piper | 315/362 |
| 3,543,032 | 11/1970 | Kazan | 250/213 R |
| 4,019,807 | 4/1977 | Boswell et al. | 250/213 R |
| 4,024,391 | 5/1977 | Bosserman et al. | 250/213 VT |
| 4,176,275 | 11/1979 | Korn et al. | 250/213 R |
| 4,481,531 | 11/1984 | Warde et al. | 313/528 |
| 4,555,731 | 11/1985 | Zinchuk | 250/213 VT |

OTHER PUBLICATIONS

"Wedge and Strip Anodes for Centroid-Finding Position-Sensitive Photo Nand Particle Detectors" Review Scientific Instruments, Jul. 1981, vol. 52, pp. 1067–1074.

Panitz: "Video Recording of Low Intensity CEMA Images" J. Vac. Sci. Technol., 17(3), May/Jun. 1980, pp. 757–758.

*Primary Examiner*—David C. Nelms

*Attorney, Agent, or Firm*—Frishauf, Holtz, Goodman & Woodward

[57] ABSTRACT

A position-sensitive radiation detector includes a substrate and an electrically conductive electrode system which is arranged on a surface of said substrate and the configuration and arrangement of which permits position determination of a charge carrier beam impinging thereon. The substrate and the electrode system each consist of a transparent material, for example glass, or a mixture of indium oxide and tin oxide. Disposed on the electrode system is a layer of luminescent material. The present radiation detector permits at the same both an electronic and an optical signal acquisition, the latter for example photographically, visually or by means of an optoelectronic device, such as a video camera, which picks up the light passing through the substrate. Due to the combined electronic and optical signal acquisition the radiation detector can be used in a very large intensity range.

17 Claims, 5 Drawing Sheets

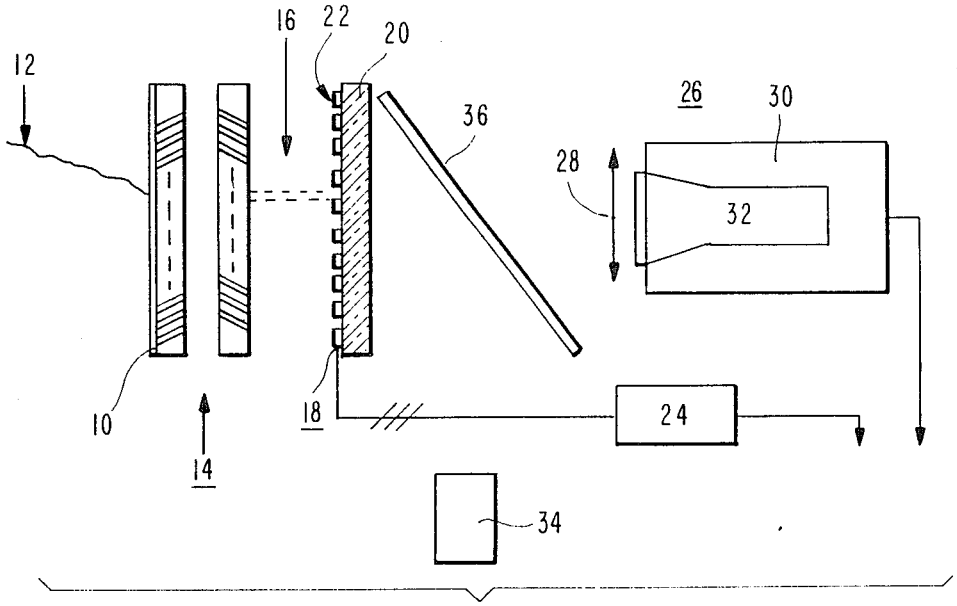
FIG. 1
FIG. 2
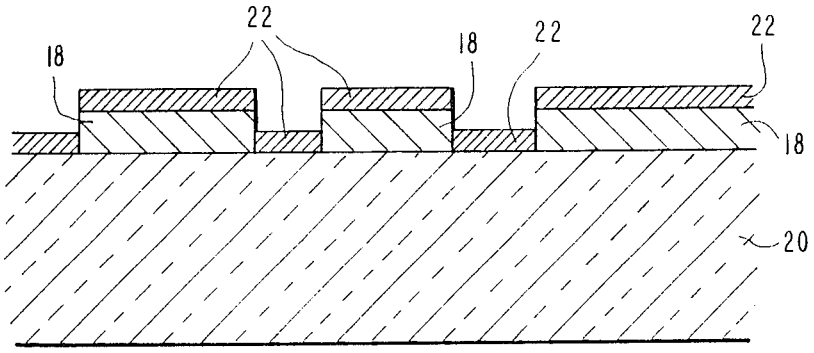

POSITION-SENSITIVE RADIATION DETECTOR

FIELD OF THE INVENTION

The present invention relates to the detection of radiation, in particular position-sensitive radiation detectors.

DESCRIPTION OF THE RELATED ART

A position-sensitive radiation detector is described in the publication of C. Martin et al. in Rev. Sci. Instrum. 52 (7), July 1981, 1067–1074. Radiation detectors of the type of interest here comprise an electrically conductive electrode system which is arranged on the surface of a substrate and the configuration and arrangement of which permits determination of the position of an incident charge carrier beam in two coordinate directions. A known electrode system of this type includes four electrodes, an electrode pair having opposing wedge-shaped electrode portions each tapering towards the other electrode and a second electrode pair nested in the first and comprising adjacent strip-shaped electrodes whose widths vary oppositely transversely of their longitudinal direction. The impingement position of a radiation beam of adequate cross-section can be determined with this electrode system in two mutually perpendicular coordinate directions from the ratio of the charge carrier streams absorbed by the individual electrodes. Electrode systems of this type also exist which have only three electrodes and anode arrays in which the position of an impinging charge carrier beam can be determined in polar coordinates. When the radiation distribution is optical (electromagnetic) radiation it is converted as position-true as possible to a corresponding charge carrier distribution, in particular electron distribution, which can be done for example by a photocathode and a following photoelectron multiplier system, e.g. microchannel plates.

Apart from position-sensitive radiation detectors of the aforementioned type operating with electronic signal acquisition, the publication of Panitz in J. Vac. Sci. Technol., 17 (3), May/June 1980, 757, 758 also discloses a position-sensitive radiation detector operating with optical signal acquisition. In this optical radiation detector, by the radiation distribution to be detected, a luminescent layer is stimulated to luminescence and the resulting optical radiation distribution is converted with a television camera, for example vidicon camera, to a corresponding electrical video signal.

Furthermore, position-sensitive radiation detectors exist whose electrode system consists of a single resistance electrode or an array of silicon-photoelement segments, cf. for example the Dissertation by Thomas Schiller, Technical University, Berlin, 1985, p. 30, 31.

A disadvantage of the known radiation detectors is that they do not permit simultaneous optical and electrical signal acquisition. This would however for example be desirable when the intensity range of the radiation to be detected covers several powers of ten or when in measurements in which small input signal intensities are to be expected adjustment can be made by visual observation in a preliminary test with high intensities. Detectors on a silicon basis have high noise and can only be baked out to a limited extent. Detectors with resistance electrodes suffer from high geometrical distortions. The two latter detector types cannot detect more than $10^6$ events per second.

SUMMARY OF THE INVENTION

The main objective of the invention is to provide a position-sensitive radiation detector which permits at the same time both an electronic and an optical signal acquisition and is distinguished by a high dynamic range.

Apart from the possibility of simultaneous electronic and optical signal acquisition, the radiation detector according to the invention has the further substantial advantage of a high dynamic range which extends up to about $10^{13}$ events per second and more.

A preferred embodiment of the present radiation detector includes a disc-shaped substrate of optically transparent material, furthermore an electrode system which is arranged on the major surface of the substrate and the configuration and arrangement of which permits a position determination of impinging charge carriers and which consists according to the invention of optically transparent material, and a luminescent substance layer which is arranged on the side of the electrode system facing the charge carrier source.

The electrode system of the preferred radiation detector comprises electrodes of a mixture of indium oxide and tin oxide, the ratio of indium to tin being about 20:1 and the tin oxide being present solely in the form of $SnO_2$ while the indium oxide may be present in all its oxidation stages $In_2O_3$ . . . InO.

The layer forming the transparent electrode array may be deposited chemically from the gas phase by CVD (chemical vapor deposition) or by a sputtering method as a thin layer.

When the radiation to be detected is electromagnetic radiation it is converted for example by a photocathode true to position to a corresponding charge carrier, in particular electron, pattern.

The charge carrier pattern is preferably amplified by a multiplier, such as a channel plate or other secondary electron multiplier (SEM) system, before it is incident on the electrode array of the radiation detector.

BRIEF DESCRIPTION OF THE DRAWINGS

Hereinafter examples of embodiment of the invention will be explained with reference to the drawings, wherein:

FIG. 1 is a schematic illustration of a preferred embodiment of the position-sensitive radiation detector according to the invention;

FIG. 2 is a greatly enlarged cross-section through a part of a detector anode;

Figure 3:
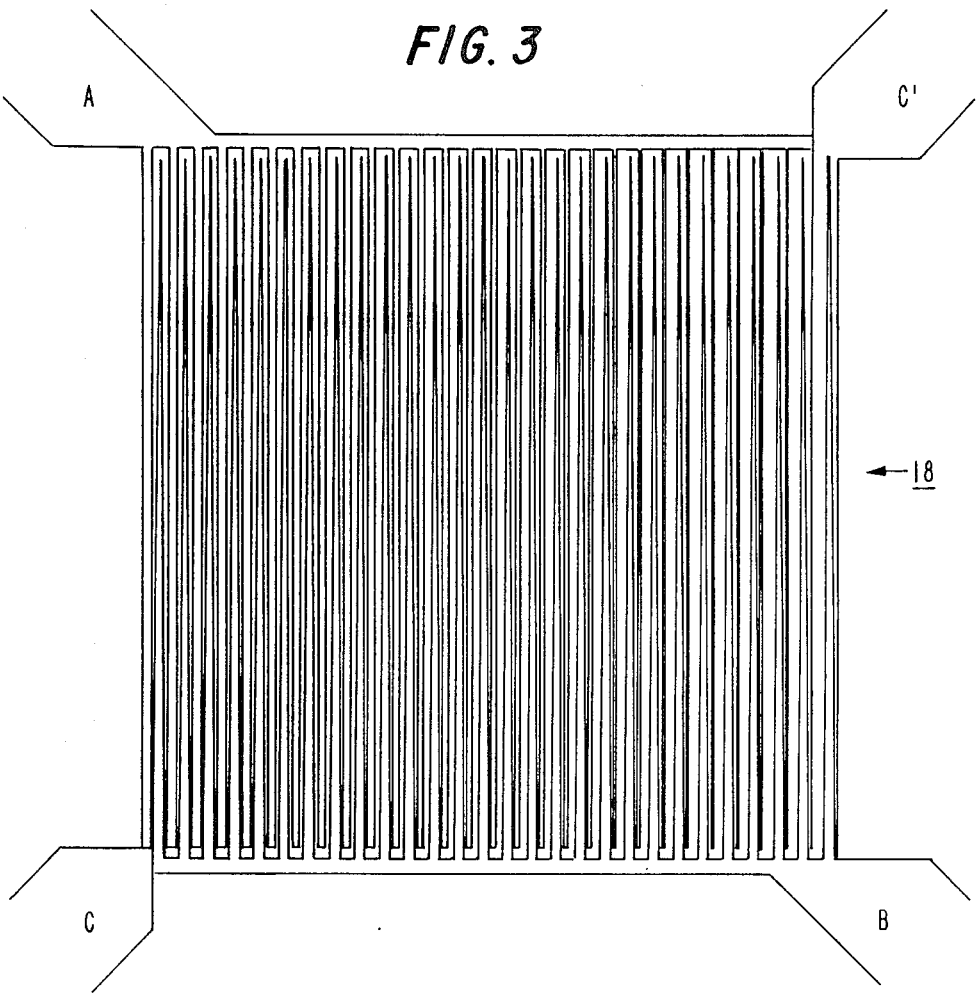
FIG. 3 is a plan view of a preferred electrode system for a detector anode and FIGS. 4, 5 and 6 are individual view of the three electrodes of the electrode system of FIG. 3. p The preferred radiation detector system illustrated schematically in FIG. 1 includes a sheet-like photocathode 10 for position-true conversion of an impinging optical radiation distribution (radiation pattern, image) 12 to a corresponding electron distribution. The electron distribution is amplified position-true by a secondary electron multiplier. The secondary electron multiplier includes in the preferred embodiment illustrated two microchannel plates connected in series. The amplified electron distribution 16 is incident onto an electrode system connected as anode array 18 and arranged on a surface of a substrate 20. The electrode system 18 includes a plurality of electrodes (see FIG. 3 and the aforementioned publication of Martin et al.) whose configuration and arrangement permits determination of the position of an impinging charge carrier beam of adequate cross-section. As described up till now the radiation detector is known.

According to the invention the substrate 20 consists of an optically transparent material such as glass. Furthermore, the electrodes of the electrode system 18 consist of an electrically conductive and optically transparent material. Also, at least on the electrodes, preferably on the entire electrode-side surface of the electrode-substrate array, a layer 22 of luminescent material (phosphor) is disposed as shown more exactly in FIG. 2. The luminescent material may consist in known manner of a doped semiconductor compound such as CdSe:Ag.

The electrodes of the electrode system 18 may consist of a metal, such as Au, of metal oxides, such as $SnO_2$, $In_2O_3$, RuO, possibly doped with a non-metal such as fluorine, and so-called "organic metals" such as polycarbazoles, polyphenothiazines (doped with iodine), which are transparent in the form of a thin layer or at least translucent. In the embodiment preferred at present a mixture of indium oxide and tin oxide is used, the ratio of indium to tin being about 20:1. The tin oxide is present solely in the form of $SnO_2$ whilst the indium oxide may be present in all the oxidation stages $In_2O_3$. . . InO.

The indium oxide-tin oxide layer may be deposited from the gas phase by CVD (chemical vapor deposition) or by a sputtering method in known manner.

The electrode system 18 makes it possible to detect the position and intensity of impinging electron pulses in known manner by means of a signal processing unit 24 which furnishes for example a digital output signal. With the radiation detector according to the invention however simultaneous optical-electronic signal acquisition is also possible. For this purpose in the example of embodiment illustrated in FIG. 1 on the side of the transparent substrate 20 remote from the electrode system 18 an optoelectronic image pickup system 26 is disposed which comprises an objective lens 28, indicated only schematically, and a television camera 30 which for example can operate with a vidicon or a charge-coupled device (CCD) and furnishes a video signal which represents the optical radiation distribution generated by the luminescent material layer 22. Instead of the optical-electronic image pickup system 26 or additionally thereto means may also be provided for visual-optical observation and/or photographic recording of the visible image generated by the luminescent layer 22, for example an eyepiece 34 and a partially reflecting mirror 36 disposed between the substrate 20 and the objective 28.

Figure 4:
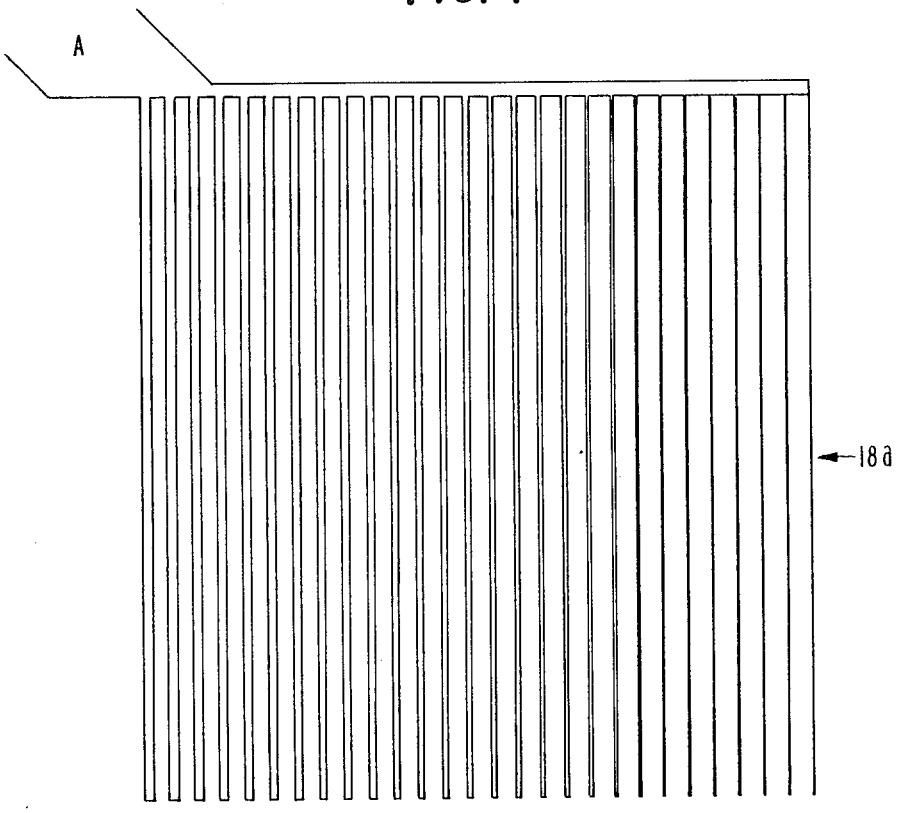
Figure 5:
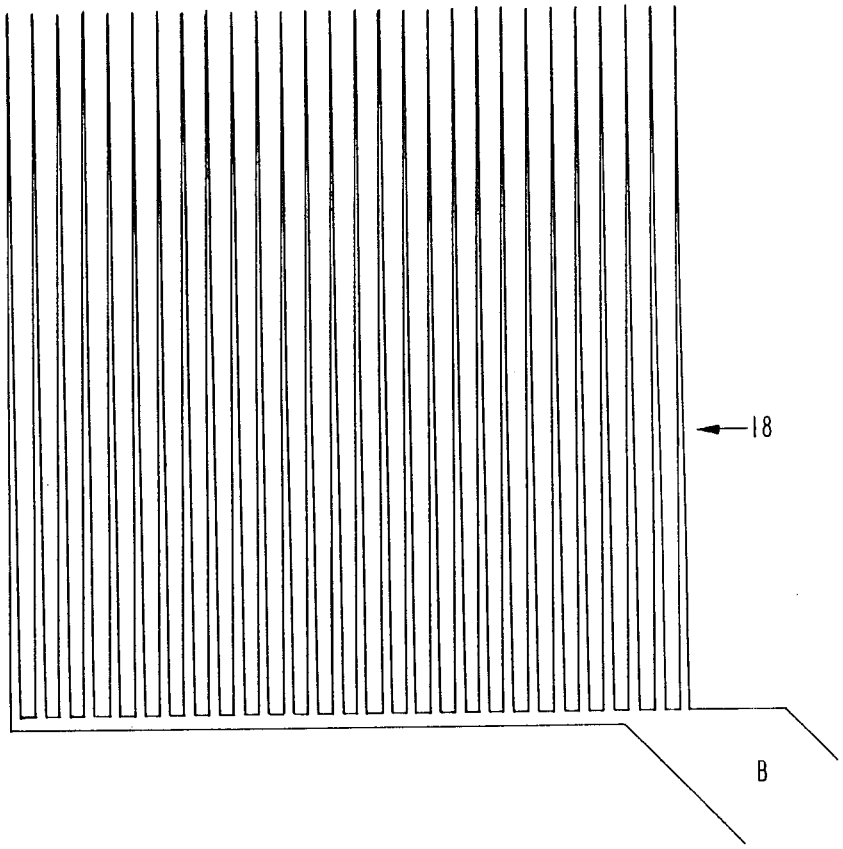
Figure 6:
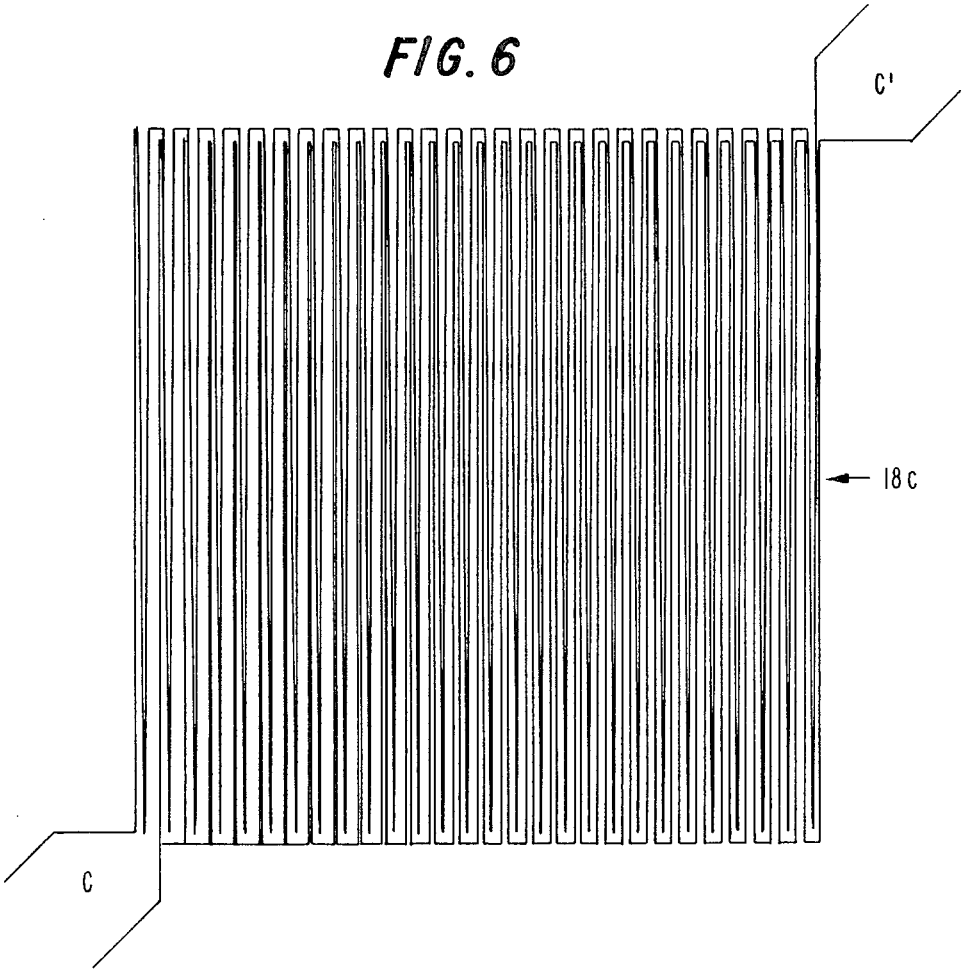

An advantageous electrode system which is known in principle from the publication of Martin et al.(l.c.) is illustrated in FIGS. 3 to 6. FIG. 3 shows the electrode system as a whole. In FIGS. 4, 5 and 6 the three electrodes 18, **18*b* and 18*c*** of the electrode system are shown separately.

The first electrode **18*a* illustrated in FIG. 4 and comprising a terminal A consists of a comb-like array of strips with width decreasing from the left to the right. The second electrode 18*b* illustrated in FIG. 5 and having a terminal B includes an array of identical wedge-shaped electrode portions which extend into the intermediate spaces between the strips of the electrode 18*a*. Between the projecting electrode portions of the electrodes 18*a* and 18*b* there is a third meander-shaped electrode 18*c* which in the electrode system of FIG. 3 occupies the intermediate space between the electrodes 18*a* and 18*b* and has two terminals $C_1$, $C_2$. The width of the upper, in FIG. 3, substantially V-shaped ends of the meander winding decreases from the left to the right and in addition the ratio of the widths of the legs of said windings changes in the manner shown in FIG. 6**.

The invention can of course also be implemented with other electrode configurations, for example the other electrode configurations which are described in the aforementioned publication of Martin et al., and also with a resistance electrode of the type mentioned at the beginning. It may be applied not only in position detectors of the type described and mentioned but also for example in field-ion microscopes, transmission raster microscopes, X-ray microscopes images converters and amplifiers, such as night-sight devices, image pickup means for astronomical purposes, LEED systems (low energy electron diffraction), etc.

We claim

1. High-dynamic-range position-sensitive radiation detector comprising a substrate (20) and an electrode system (18) which is disposed on a surface of the substrate and the configuration and arrangement of which permits a position determination of a charge carrier beam (16) impinging thereon, further comprising, electro-luminescent material (22) deposited on the side of the electrode system (18) subjected to the charge carrier beam, and wherein (a) the electrode system (18) consists of a transparent material; and (b) the substrate (20) consists of a transparent material, thereby permitting visual observation (32, 34), through said electrode system and substrate, of charge carrier impact on said electro-luminescent material (22).

2. Radiation detector according to claim 1, characterized luminescent material layer (22) covers both the electrode system (18) and any electro-free regions of the surface of the substrate (20).

3. Radiation detector according to claim 1, characterized by a means (26; 34, 36) for optical detection of the optical radiation distribution generated by charge carrier impacts on the luminescent material layer (22).

4. Radiation according to claim 3, characterized in that the means for optical detector include an optoelectronic means such as a television camera (30).

5. Radiation detector according to claim 3, characterized in that the means for optical detection includes a means (34, 36) for visual observation of the optical radiation distribution.

6. Radiation detector according to claim 1, characterized in that in front of the electrode system (18) a secondary electron multiplier (14) is disposed.

7. Radiation detector according to claim 1, characterized in that the transparent electrode arrangement consists of a mixture of indium oxide and tin oxide.

8. Radiation detector according to claim 7, characterized in that the ratio of indium to tin is about 20:1.

9. Radiation detector according to claim 7, characterized in that tin oxide is present as $SnO_2$ while the indium oxide is present in various oxidation stages.

10. Radiation detector according to claim 1, characterized in that the electrode arrangement comprises an electrode consisting of resistance material.

11. Electro-optical means including a substrate (20) of an optically transparent material and at least one optically transparent electrode (18) which is arranged on a surface of the substrate in a configuration which permits electrical determination of a position of a charge carrier beam (16) including thereon, and consists essentially of a mixture of indium oxide and tin oxide.

12. Means according to claim 11, characterized in that the ratio of indium oxide to tin oxide is about 20:1.

13. Means according to claim 11, characterized in that the tin oxide is present as $SnO_2$ and the indium oxide in several oxidation stages.

14. Means according to claim 11, characterized in that a luminescent material layer is disposed on the transparent electrode.

15. High-dynamic-range position-sensitive radiation detector for simultaneous optical and electrical acquisition of data representing incident radiation position comprising a substrate (20) and an electrode system (18) which is disposed on a surface of the substrate and the configuration and arrangement of which permits a position determination of a charge carrier beam (16) impinging thereon, further comprising, electro-luminescent material (22) deposited on the side of the electrode system (18) subjected to the charge carrier beam, and generating optically observable (32,34) indications of impacts thereon of said charge carrier beam, and wherein (a) the electrode system (18) consists of a transparent material, and generates electrical data representative of the positions of impacts of charge carriers thereon; and (b) substrate (20) consists of a transparent material, thereby permitting visual observation (32,34) through said electrode system and substrate, of charge carrier impact on said electro-luminescent material (22).

16. Detector according to claim 15, wherein (FIG. 5) said electrode system configuration includes wedge-shaped electrodes tapering from one edge of said electrode system to an opposing edge.

17. Detector according to claim 15, wherein said electrode system configuration includes wedge-shaped electrodes tapering from one edge of said electrode system toward a center thereof.

* * * * *